United States Patent [19]

Kaestner

[11] 4,059,952

[45] Nov. 29, 1977

[54] BIO-RHYTHM CALCULATOR

[76] Inventor: Erwin Kaestner, 8125 Brill Road, Cincinnati, Ohio 45243

[21] Appl. No.: 690,515

[22] Filed: May 27, 1976

[51] Int. Cl.[2] ..... G04B 19/24; G04B 19/30; G04B 19/06; G06C 27/00

[52] U.S. Cl. ..... 58/4 R; 58/50 R; 58/125 B; 58/127 R; 235/74

[58] Field of Search ..... 58/125 B, 126 A, 127 R, 58/50 R, 4 R; 235/74, 78, 83, 88

[56] References Cited

U.S. PATENT DOCUMENTS

| | | | |
|---|---|---|---|
| 2,105,470 | 1/1938 | Bower | 58/39.5 |
| 3,253,780 | 5/1966 | Stewart | 235/83 |
| 3,708,971 | 1/1973 | Wlodyka | 58/3 |

*Primary Examiner*—E. S. Jackmon
*Attorney, Agent, or Firm*—Melville, Strasser, Foster & Hoffman

[57] ABSTRACT

A calculator for continuously exhibiting the status of an individual's Bio-Rhythm cycles and, in particular, an individual's physical, emotional and intellectual Bio-Rhythm cycles. The calculator comprises a display panel having three dial faces corresponding to the three Bio-Rhythm cycles and each having indicia thereon defining the critical days within its particular cycle. Indicating elements are provided to sequentially scan each of the dial faces wherein the physical dial face is scanned once in a 23 day period, the emotional dial face once in a 28 day period and the intellectual dial face once in a 33 day period. A high or low critical day in any one of the Bio-Rhythm cycles is defined when the position of an indicating element corresponds to the critical indicia on a dial face. The calculator may be personalized by appropriately presetting the indicating elements relative to their dial faces based on data derivable from an individual's birth date.

2 Claims, 5 Drawing Figures

BIO-RHYTHM CALCULATOR

BACKGROUND OF THE INVENTION

1. Field of the Invention

The apparatus of the present invention relates generally to horological calculating devices and, in particular, to a calculator which may be personalized for continuously exhibiting the status of an individual's physical, emotional and intellectual Biorhythm cycles.

2. Description of the Prior Art

The theory of Bio-Rhythm is based on the fact that mankind, as an integral part of nature, responds to many finite cycles. For example, members of the medical profession have recognized cycles lasting as long as 7 years in areas of cell growth and replacement, to cycles as short as pulse rates, menstrual periods, temperature cycles, etc. The three cycles of Bio-Rhythm have been recognized to comprise: (1) The Physical Cycle — 23 days — which affects our well-being, strength, resistance to illness and injury, energy, etc.; (2) The Emotional Cycle — 28 days — which affects our sensitivity, stability, moods, creative endeavors, intuition, etc.; and (3) The Intellectual Cycle — 33 days — which affects our memory, logic, decision making competency, analytical power, learning capability, etc.

According to the theory of Bio-Rhythm, each of the three cycles, although differing in length from each other, starts on an individual's birthdate at an average or zero level. Each cycle then rises to a high point and returns again to the zero level. The cycle then drops to a low point after which it again returns to the zero level thereby completing one cycle. Although the magnitudes of the high and low points may vary from cycle to cycle as well as from individual to individual, the crossover points, where the curves transition from high to low magnitudes and from low to high magnitudes, are constant and define critical days within each cycle. The days intermediate the critical days have been determined to be of lesser consequence and are frequently referred to as high and low periods corresponding to the high and low magnitudes of the Bio-Rhythm cycles.

Although much data has been accummulated in the art supporting the theory of Bio-Rhythm prior art means for applying this data to provide practical guidance for an individual's daily life pattern have all been characterized by serious shortcomings. In particular, heretofore prior art devices for determining Bio-Rhythm cycle status have generally necessitated the performance of daily calculations of one sort or another. Exemplary of such prior art devices requiring daily attention include various charts and/or templates, massive data tables, circular slide rules and mini-calculators preprogrammed with a general Bio-Rhythm program. It is believed that the constant attention demanded by these prior art devices has significantly impeded the general acceptance and use of Bio-Rhythm cycle data by the public.

SUMMARY OF THE INVENTION

In view of the foregoing, it is, in general, an object of the present invention to provide a Bio-Rhythm calculator whose use requires minimal effort on the part of an individual.

More specifically, it is an object of the present invention to provide a calculating device for continuously exhibiting the status of an individual's physical, emotional and intellectual Bio-Rhythm cycles and requiring no continuous supervision from the user thereof.

A further object of the present invention is to provide a Bio-Rhythm calculating device which may be personalized to a particular individual and which will thereafter automatically provide a continuing visual display of the status of that individual's Bio-Rhythm cycles.

In accordance with these and other useful objects there is provided a calculating device operable for continuously exhibiting the status of an individual's physical, emotional and intellectual Bio-Rhythm cycles. The calculator comprises a display panel having three dial faces corresponding to the three Bio-Rhythm cycles. Each of the display faces has associated therewith indicia defining the two critical days within its respective cycle as well as indicia locating the high and low periods therebetween.

An indicating element is operatively associated with each of the three dial faces for sequentially scanning and identifying the indicia thereon. In order to account for the varying lengths of the individual Bio-Rhythm cycles, the indicating element associated with the physical cycle repetitively scans its dial face in 23 day periods, the indicating element associated with the emotional cycle in 28 day periods and the indicating element associated with the emotional cycle in 33 day periods. Means are also provided whereby the calculating device may be personalized to a particular individual by appropriately presetting the indicating elements to identify certain indicia on the display faces prior to operating the device.

After appropriately presetting the calculating device, the indicating elements will be caused to continuously and repetitively scan the indicia on the dial faces. And, all that one need do thereafter to determine the status of any one of his Bio-Rhythm cycles is simply note the position of the indicating elements relative to the indicia on their respective dial faces. That is, if an indicating element is identifying indicia corresponding to a particular critical day, such is immediately noted and so on.

DESCRIPTION OF THE PREFERRED EMBODIMENTS

Figure 1:
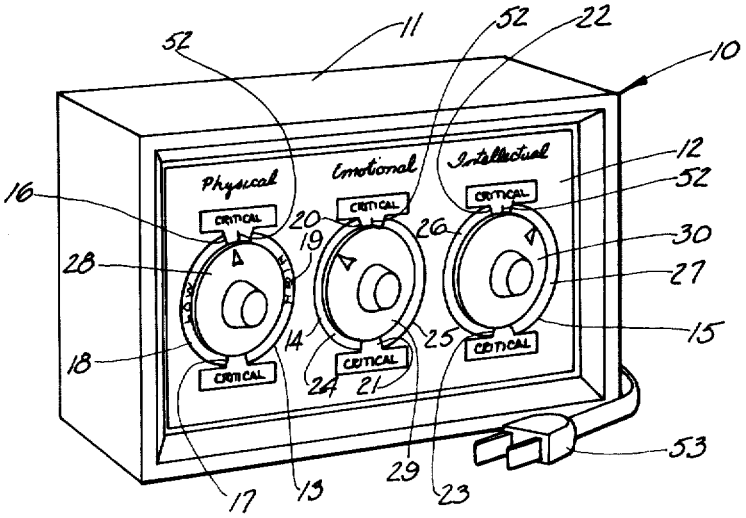
FIG. 1 is a perspective view showing the completed assembly of an electro-mechanical embodiment of the Bio-Rhythm calculating device of the present invention.

Referring now to the drawings, wherein like numerals identifying corresponding components, FIG. 1 shows, in perspective, an electro-mechanical embodiment of the Bio-Rhythm calculating device 10 of the present invention. The Bio-Rhythm calculating device 10 is contained within a housing 11 and includes a display panel 12. In order to provide a display representing the three Bio-Rhythm cycles, display panel 12 is divided into three general sections, one section representing the physical Bio-Rhythm cycle and the remaining two sections representing the emotional and intellectual Bio-Rhythm cycles.

Each section of display panel 12 includes a similarly configured dial face 13, 14, 15 bearing certain indicia identifying the various stages of its Bio-Rhythm cycle. For example, dial face 13, associated with the physical Bio-Rhythm cycle, presents a circular locus of points marked to exhibit a pair of relatively narrow diametrically opposed segments 16 and 17 incorporating those points defining the critical days in the physical Bio-Rhythm cycle. Intermediate segments 16 and 17, the locus of points represented by circular dial face 13 is marked to exhibit a pair of diametrically opposed segments 18 and 19 corresponding to, respectively, the low and high periods in the physical cycle. In a similar manner, dial faces 14 and 15 are marked to exhibit diametrically opposed pairs of segments 20, 21 and 22, 23 representing the critical days in the emotional and intellectual cycles as well as diametrically opposed segment pairs 24, 25 and 26, 27 representative of the low and high periods in the cycles.

Each of the dial faces 13, 14 and 15 has, in respective association therewith, an indicating element 28, 29 and 30. Indicating elements 28, 29 and 30, which are mounted on display panel 12 for relative rotation with respect to dial faces 13, 14 and 15, include central knob portions 31, 32 and 33 and skirt members 34, 35 and 36 surmounted thereon. Skirt member 34 is marked along its periphery with indicia dividing it into 23 equal sections, skirt member 35 with indicia dividing it into 28 equal sections and skirt member 36 with indicia dividing it into 33 equal sections. In addition, each of the skirt members 34, 35 and 36 is marked with an arrowhead indicia 37, 38 and 39 at a position overlying one of the dividing indicia for pointing toward the periphery of the dial face. It will be understood that other types of indicia may be substituted for the arrowhead 37, 38 and 39 to provide the required indications. For reasons to be explored in more detail hereinafter, each of the division of each of the skirt members 34, 35 and 36 represent one day in the corresponding Bio-Rhythm cycle. Therefore, the physical cycle is represented by a total of 23 days on skirt member 34, the emotional cycle by 28 days on skirt member 35 and the intellectual cycle by 33 days on skirt member 36.

Figure 2:
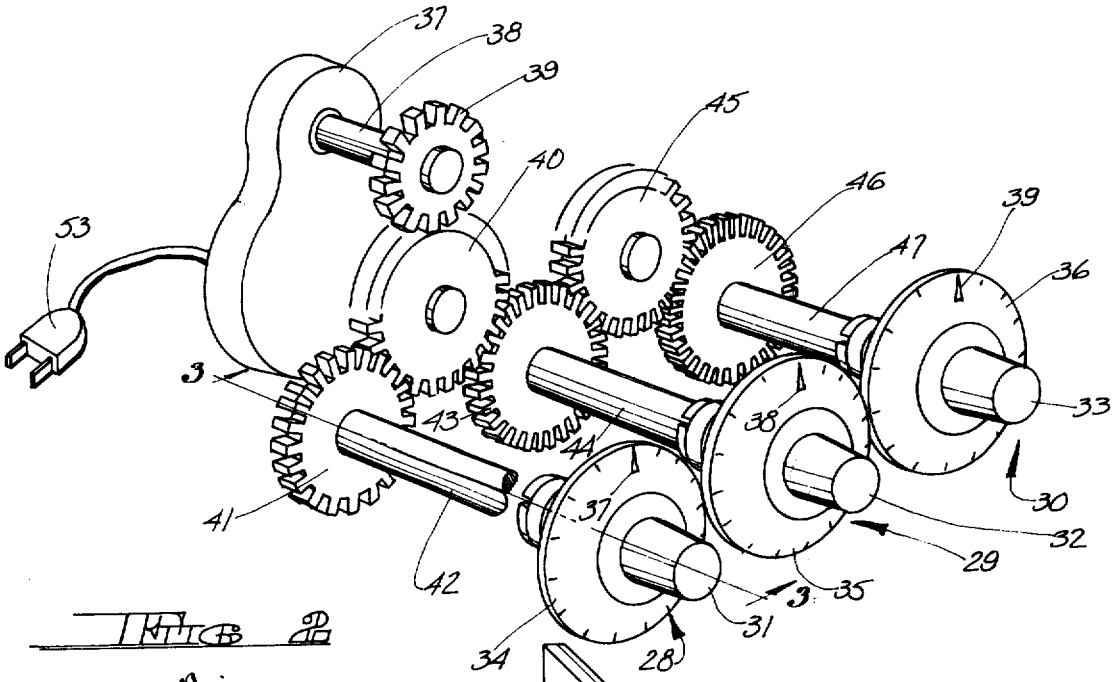
FIG. 2 is a perspective view showing the operative features of the Bio-Rhythm calculating device shown in FIG. 1, and in particular, showing the gearing arrangement thereof.

Referring now to FIG. 2, an arrangement of gears is disclosed which, when operatively connected to indicating elements 28, 29 and 30, will operate the Bio-Rhythm calculating device 10 for accurately and continuously providing a display of the three Bio-Rhythm cycles. Accordingly, prime mover or motor 37 and its associated output shaft 38 is provided for operating driver gear 39. Component characteristics are selected such that the number of teeth on driver gear 39 equals the number of days required for motor 37 to perform one complete revolution. For example, motor 37 may conveniently be selected so as to cause output shaft 38 to accomplish one complete revolution in 15 days, in which case, driver gear 39 is characterized by a total of 15 teeth. Therefore, each of the 15 teeth of driver gear 39 will advance one position per day and perform one complete rotation of 360° every 15 days.

Driver gear 39 meshes with idler gear 40 which, in turn, meshes with control gear 41. Preferably, both idler gear 40 and control gear 41 have 23 teeth whereby each tooth of control gear 41 advances one position per day and completes one entire rotation of 360° in 23 days in response to operation of driver gear 39. Consequently, shaft 42 of control gear 41 will cause indicating element 28 to rotate relative to dial face 13 completing and entire revolution thereabout in 23 days. And, since skirt member 34 of indicating element 28 is divided into 23 equal sections, each section will advance one position per day thereby representing the passing of one day in the physical Bio-Rhythm cycle.

Idler gear 40 also meshes with control gear 43, the latter having 28 teeth. Therefore, in response to the operation of driver gear 39, each tooth of control gear 43 advances one position per day and completes one entire rotation of 360° in 28 days. In manner similar to that previously explained with regard to the physical Bio-Rhythm cycle, shaft 44 of control gear 42 will rotate indicating element 29 relative to dial face 14 causing it to complete a full revolution thereabout in 28 days. Accordingly, each of the 28 equal divisions or sections of skirt member 35 will advance one position per day thereby representing the passage of one day in the 28 day cycle of the Bio-Rhythm emotional cycle.

Finally, control gear 43 meshes with a second idler gear 45, preferably also having 23 teeth, which in turn meshes with control gear 46. Control gear 46 has 33 teeth whereby each of the 33 equal sections of skirt member 36 of indicating element 30 is caused, by means of shaft 47, to advance one position per day relative to dial face 15 in response to operation of driver gear 39. As before, each section of skirt member 36 will therefore represent one of the 33 days in the intellectual Bio-Rhythm cycle.

Figure 3:
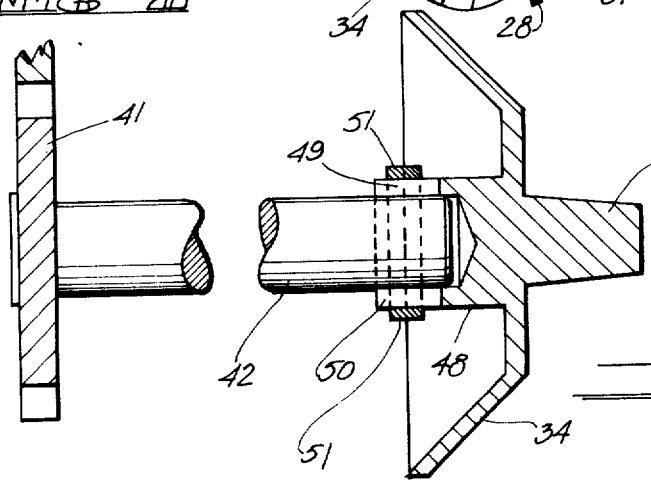
FIG. 3 is a partial cross-sectional view taken along line 3—3 of FIG. 2.

In order to personalize the Bio-Rhythm calculating device 10 to a particular individual, the indicating elements 28, 29 and 30 must initially be preset to particular positions relative to their respective dial faces 13, 14 and 15. This presetting procedure is facilitated by means of the interface between indicating elements 28, 29 and 30 and their associated shafts 42, 44 and 47 as generally shown in FIG. 3. While FIG. 3 specifically shows the connection between indicating element 28 and shaft 42, it will be understood that indicating elements 29 and 30 connect to shafts 44 and 47 in an identical manner. With this in mind, indicating element 28 includes a hub member 48 extending from knob 31 and having a pair of diametrically opposed slotted sections 49 and 50. Hub member 48 is thereby slightly flexible to facilitate reception of shaft 42. A compression ring 51 is then surmounted over slotted hub member 48 to achieve a friction fit between indicating element 28 and shaft 42. Although the friction fit provides sufficient holding force to allow shaft 42 to operate indicating element 28 in response to rotation of driver gear 39, due to the large resistance presented by the gear train, hub member 48 will slip about shaft 42 in response to manual rotation of knob 31. Consequently, each of the indicating elements 28, 29 and 30 may be independently preset to a particular position by manual rotation of knobs 31, 32 and 33.

Although various aids are available for facilitating the determination of the positions to which the indicating elements 28, 29 and 30 must be preset in order to personalize the calculating device 10, they all are founded on basic Bio-Rhythm theory. In general terms, this requires that the individual add up the days of his life and divide this number by 23, 28 and 33 respectively. Each division operation will result in a whole number indicating the number of complete cycles in each Bio-Rhythm cycle having occured to date, and a remainder which represents the number of days which have transpired since the last complete cycle. The remainder resulting from each division operation defines the factor by which the indicating elements 28, 29 and 30 must be preset. For example, assume that the remainders calculated for the physical, emotional and intellectual cycles are 7, 8 and 20 respectively. To preset indicating element 29 of the physical cycle, knob 31 is initially set so that arrowhead 37 is in alignment with index line 52. Knob 31 is then manually rotated in a clockwise direction while counting the number of dividing indicia on skirt member 34 that align with index line 52. When the count reaches 7, rotation of knob 31 is terminated and the indicating element 28 is appropriately preset. Indicating elements 29 and 30 are subsequently preset in an identical manner except that rotation of knobs 32 and 33 are terminated on the counts of 8 and 20 respectively. The Bio-Rhythm calculating device 10 is then energized by inserting plug 53 into an appropriate power receptacle whereafter a continuous display of the status of the individual's Bio-Rhythm cycles is presented.

After the Bio-Rhythm calculating device 10 has been preset and is operating, all one need do to immediately determine the status of his cycles is to note the position of arrowheads 37, 38 and 39 relative to dial faces 13, 14 and 15. For example, if arrowhead 37 is pointing to either critical segment 16 or 17, this is an indication of a critical day in terms of the individual's physical Bio-Rhythm cycle. Similarly, if arrowhead 37 is pointing to either low segment 18 or high segment 19, this indicates that the individual is in the lower or upper part respectively of his physical Bio-Rhythm cycle. Furthermore, by counting the number of divisions on skirt member 34 by which arrowhead 37 is disposed from a critical area, one may quickly determine the number of days to his next critical day. This, of course, is possible since each division on skirt member 34 represents one day. It will be understood that the remaining two cycles, i.e., the emotional and intellectual cycles, may be interpreted in an identical manner.

Although the Bio-Rhythm calculating device 10 of the present invention has heretofore been described in terms of an electro-mechanical embodiment, it will be appreciated by those skilled in the art that the teachings herein may also be implemented by various electronic embodiments. Accordingly, one possible electronic embodiment of the present invention is shown schematically in FIGS. 4 and 5.

Figure 4:
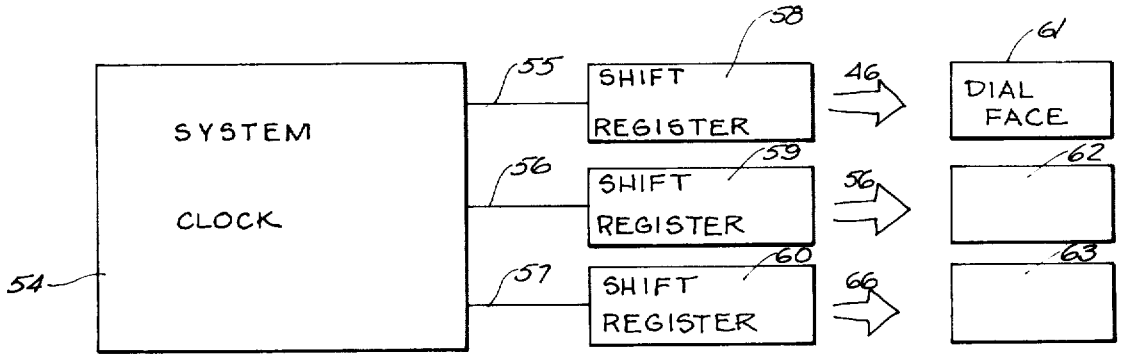
FIG. 4 is a block diagram showing the necessary elements of an electronic embodiment of the Bio-Rhythm calculating device of the present invention.

In FIG. 4, system clock 54 has three outputs 55, 56 and 57. Output 55 connects to a 46 element shift register 58 whereas outputs 56 and 57 connect to a pair of 56 and 66 element shift registers 59 and 60 respectively. Shift registers 58, 59 and 60 are of the type well known in the art and, preferably, comprise tandems of R-S flip-flops. The output of shift register 58, which comprises 46 data lines taken from the outputs of its 46 flip-flops, connects to dial face 61 which represents the physical Bio-Rhythm cycle. Similarly, the 56 and 66 line outputs of shift registers 59 and 60 connect to dial faces 62 and 63 representing the emotional and intellectual Bio-Rhythm cycles respectively.

System clock 54 is characterized in that it simultaneously develops on parallel output lines 55, 56 and 57 a timing signal having a repetition rate of one pulse per 12 hours. Shift registers 58, 59 and 60 respond to each pulse of the timing signal by shifting any binary information therein one place to the right. For example, assume that the third element or flip-flop of register 58 is initially set at logical one while the remaining flip-flops are at logical zero. In response to a pulse on output line 55, the logical one will be displaced to the fourth element of the tandem and so on. In this manner, the logical one binary digit initially appearing at the third flip-flop will be sequentially displaced through the entire tandem in one half day increments completing an entire cycle through shift register 58 in 23 days. The operation of the remaining shift registers is identical except that it will take 28 days to completely cycle through shift register 59 and 33 days to cycle through shift register 60.

Figure 5:
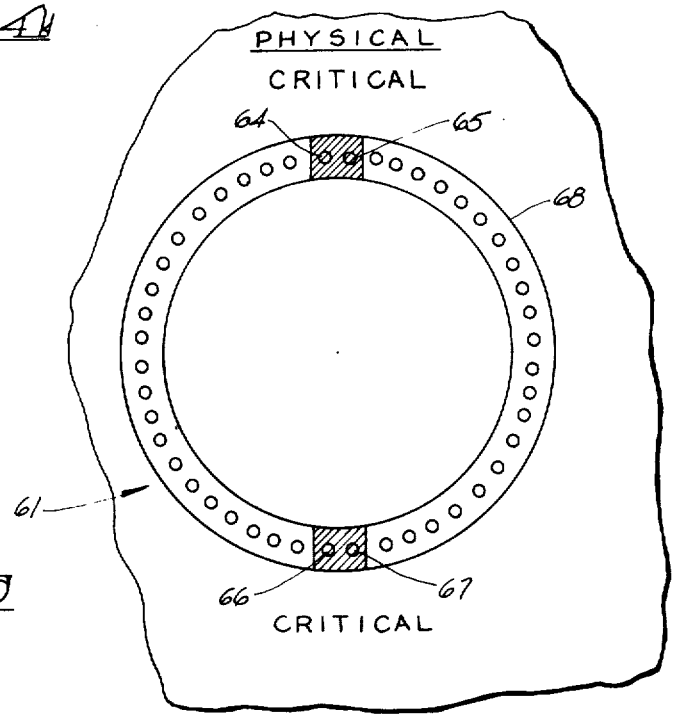
FIG. 5 is a schematic represention of one of the dial faces generally shown in FIG. 4.

FIG. 5 schematically depicts on embodiment of dial face 61 useful with the system shown generally in FIG. 4. In FIG. 5, dial face 61 comprises a circular array 68 of 46 equally spaced bulbs or the like, each bulb being represented by one of the small circles in the FIGURE. The bulb pairs 64, 65 and 66, 67 are distinguished from the other 42 bulbs by different coloring or the like and dial face 61 may include indicia identifying bulb pairs 64 and 65 and 66, 67 as critical. Alternatively, a color coded translucent overlay could be provided to distinguish bulb pairs 64, 65 and 66, 67 from the other bulbs. Each bulb in the array 68 connects to one of the 46 data lines comprising the output of shift register 58 in a manner such that spatial correspondance between the array 68 and the tandem of flip-flops comprising shift register 58 is achieved. In other words, adjacent bulbs in array 68 connect to adjacent flip-flops of shift register 58. It will be appreciated that dial faces 62 and 63 may be constructed and connected in a manner identical to that shown in FIG. 5 except that dial face 62 will have 56 bulbs and dial face 63 will have 66 bulbs. Pairs of diametrically opposed pairs of bulbs identified as critical may be also be provided.

With further reference to FIGS. 4 and 5, it will be apparent that by selecting component characteristics such that the bulbs of dial faces 61, 62 and 63 are activatable only by a logical one level output from any of the flip-flops of registers 58, 59 and 60, a Bio-Rhythm calculating device in accordance with the teachings herein may be recognized. Referring, for example, to the physical Bio-Rhythm cycle represented by dial face 61, it will be apparent that as the single bit of data is cycled through shift register 58 in response to the timing signal on output line 55, the bulbs comprising array 68 will activate in a corresponding sequence. That is, only the bulb corresponding to the position of the bit in shift register 58 will be activated at any one time. After 12 hours the bit is shifted one position in the register whereby the next bulb in a clockwise direction is activated. This sequence continues so that all 46 bulbs are individually and sequentially activated in 12 hour increments, it taking 23 days to complete a cycle about dial face 61. By noting which particular bulb is illuminated at any given time, the status of the physical Bio-Rhythm cycle is quickly and easily established. In this regard, it will be appreciated that activation of bulbs 64–67 define the critical days of the cycle.

The embodiments of the present invention shown in FIGS. 4 and 5 may be personalized in a manner similar to that previously described with reference to the embodiment disclosed in FIGS. 1–3. In this case, the set terminals of the flip-flops of shift register 58 corresponding to every other bulb following clockwise after bulb 65 is made available for manual activation and numerically marked in consecutive order. Assuming again that the physical Bio-Rhythm preset factor is 7, the seventh set terminal is activated to preset this cycle. The set terminals of the intellectual and emotional cycles are similarly made available to provide a facility for presetting these cycles. Thereafter, the device will provide a continuous display of the status of the Bio-Rhythm cycles pertaining to the individual for whom the unit was personalized.

The details described herein have been by way of example only and it will be understood that many modifications may be made without departing from the spirit of the invention. Therefore, no limitations not expressly set forth in the claims is intended or should be implied.

The embodiments of the invention in which an exclusive property or privilege is claimed are defined as follows:

1. A Bio-Rhythm calculator comprising:

a. a display panel having a first circular dial face comprising a first locus of points, a second circular dial face comprising a second locus of points and a third circular dial face comprising a third locus of points, said first, second and third loci of points corresponding, respectively, to an individual's physical, emotional and intellectual Bio-Rhythm cycles, and each marked to exhibit a pair of relatively narrow diametrically opposed arcs disposed along the periphery of each of said dial faces and incorporating those points defining the critical phase of the corresponding Bio-Rhythm cycle;

b. first, second and third pointing members rotatably associated, respectively, with said first, second and third dial faces, each of said pointing members being operable for scanning its corresponding dial face for identifying the points in its associated locus of points, each of said pointing members being independently presettable to identify any point in its associated locus of points, said first, second and third pointing members comprising, respectively, a first knob having a first circular skirt depending therefrom, said first circular skirt having indicia dividing the periphery thereof into 23 equal sections and having indicia thereon overlying one of said dividing indicia for pointing toward the periphery of said first dial face, a second knob having a second circular skirt depending therefrom, said second circular skirt having indicia dividing the periphery thereof into 28 equal sections and having indicia thereon overlying one of said dividing indicia for pointing toward the periphery of said second dial face, and a third knob having a third circular skirt depending therefrom, said third circular skirt having indicia dividing the periphery thereof into 33 equal sections and having indicia thereon overlying one of said dividing indicia pointing toward the periphery of said third dial face; and c. means for operating said first, second and third pointing members for sequentially scanning all points in said first, second and third loci of points in, respectively, 23, 28 and 33 days, said indicating means comprising means for rotatably advancing each of said circular skirts and its associated knob one division per day relative to its associated dial face, said means for rotatably advancing including a prime mover having an output shaft bearing a driver gear, a first idler gear meshing with said driver gear, first and second control gears meshing with said first idler gear and having control shafts connected respectively for rotating said first knob and circular skirt and said second knob and circular skirt relative to said first and second circular dial faces, a second idler gear meshing with said second control gear and a third control gear meshing with said second idler gear and having a control shaft connected for rotating said third knob and circular skirt and relative to said third circular dial face, the speed of said motor and the gear ratios of said driver, idler and control gears being selected for rotating said first, second and third circular skirts one division per day so as to perform respectively one complete rotation every 23, 28 and 33 days.

2. The Bio-Rhythm calculator according to claim 1 wherein each of said knobs and its associated circular skirt includes a slotted hub mounted on its associated control shaft and wherein a compression ring surmounts each of said slotted hubs such that a friction fit is achieved between said control shafts and said slotted hubs wherein said slotted hubs and associated knobs rotate in response to rotation of said control shafts and said slotted hubs slip over said control shafts when said knobs are manually rotated allow independent presetting thereof.

* * * * *